United States Patent [19]

Okada et al.

[11] Patent Number: 5,037,221

[45] Date of Patent: Aug. 6, 1991

[54] EMPHASIZED CHARACTER DOT-MATRIX PRINTER HAVING TWO GROUPS OF DOT-FORMING ELEMENTS

[75] Inventors: Hisaki Okada, Okazaki; Shigeki Akiyama, Nagoya, both of Japan

[73] Assignee: Brother Kogyo Kabushiki Kaisha, Aichi, Japan

[21] Appl. No.: 357,817

[22] Filed: May 30, 1989

[30] Foreign Application Priority Data

Jun. 2, 1988 [JP] Japan ..... 63-136267

[51] Int. Cl.[5] ..... B41J 2/51

[52] U.S. Cl. ..... 400/304; 400/121

[58] Field of Search ..... 400/121, 124, 124 VI, 400/303, 304

[56] References Cited

U.S. PATENT DOCUMENTS

| | | | |
|---|---|---|---|
| 3,727,234 | 4/1973 | Janning | 346/33 R |
| 4,079,824 | 3/1978 | Ku | 400/124 |
| 4,119,383 | 10/1978 | Watanabe et al. | 400/124 |
| 4,159,882 | 7/1979 | Sanders, Jr. et al. | 400/124 |
| 4,372,696 | 2/1983 | Pou | 400/124 |
| 4,431,319 | 2/1984 | Karaki et al. | 400/124 |
| 4,941,761 | 7/1990 | Ogawa et al. | 400/124 |
| 4,969,758 | 11/1990 | Sanders, Jr. et al. | 400/124 |

FOREIGN PATENT DOCUMENTS

| | | | |
|---|---|---|---|
| WO79/00627 | 9/1979 | European Pat. Off. . | |
| 237690 | 9/1987 | European Pat. Off. | 400/124 VI |
| 108200 | 12/1988 | European Pat. Off. | 400/124 |
| 76282 | 5/1983 | Japan | 400/304 |
| 102779 | 6/1983 | Japan | 400/304 |
| 154080 | 8/1985 | Japan | 400/124 |
| 187555 | 9/1985 | Japan | 400/124 |
| 212359 | 10/1985 | Japan | 400/124 |
| 230854 | 11/1985 | Japan . | |
| 27270 | 2/1986 | Japan | 400/82 |
| 192560 | 8/1986 | Japan | 400/124 |
| 225065 | 10/1986 | Japan | 400/124 |
| 119052 | 5/1987 | Japan | 400/121 |
| 267151 | 11/1987 | Japan | 400/304 |
| 2012088A | 12/1978 | United Kingdom . | |
| 2157865 | 10/1985 | United Kingdom | 400/121 |

*Primary Examiner*—David A. Wiecking

*Attorney, Agent, or Firm*—Oliff & Berridge

[57] ABSTRACT

A dot-matrix printer for printing characters in a matrix of dots wherein columns of dots each column consisting of a suitable number of dots and extending in a given direction are arranged at a predetermined printing pitch in a printing direction intersecting the direction of the columns of dots. The printer has a print head which is moved in the printing direction and has a first and a second group of dot-forming elements for forming dots such that the dots formed by the second group correspond to the dots formed by the first group and are spaced in the printing direction, by a predetermined distance from the corresponding dots formed by the first group, if the first and second groups of dot-forming elements are activated simultaneously. A first and a second control device are provided for selectively activating the dot-forming elements of the first and second groups, respectively, during movement of the print head, according to dot information representative of characters, such that a character formed by the first group of dot-forming elements and the same character formed by the second group of dot-forming elements have a predetermined positional relation with each other.

11 Claims, 6 Drawing Sheets

EMPHASIZED CHARACTER DOT-MATRIX PRINTER HAVING TWO GROUPS OF DOT-FORMING ELEMENTS

BACKGROUND OF THE INVENTION

1. Field of the Invention

The present invention relates to a dot-matrix printer wherein characters are printed in the form of dots, and more particularly to a dot-matrix printer capable of effecting an overlap printing wherein same characters are at least partially superimposed on each other.

2. Discussion of the Prior Art

In a dot-matrix printer, characters such as alphabetic letters, Chinese characters, Japanese "kana" letters, numerals and symbols are printed by forming dots on a recording medium, in a dot-matrix pattern, such that columns of dots each of which consists of a suitable number of dots and extends in a given direction are arranged at a predetermined printing pitch (hereinafter referred to as "nominal printing pitch") in a printing direction which intersects the direction of extension of the columns of dots. Generally, the dot-matrix printer includes (a) a print head having a plurality of dot-forming elements each for forming a dot such that the dots printed by the dot-forming elements are arranged in a column extending in the above-indicated given direction, (b) feeding means for moving the print head in the above-indicated printing direction, and (c) printing control means for controlling the dot-forming elements to be selectively activated to print the corresponding dots, according to dot information representative of ordinary characters to be printed, while the print head is moved by the feeding means.

Some dot-matrix printers are capable of effecting an "overlap" printing wherein two printings are partially superimposed on each other, with a suitable offset distance therebetween in a certain direction, to print a bold-faced character, or the two printings are completely superimposed or overstruck on each other, to print a character with increased darkness or density. In these known dot-matrix printers, the print head is first fed in a predetermined printing direction to effect a normal first printing of characters, and is then returned in the opposite direction to the beginning of the printed line of characters, so that a second printing operation is effected also in the same printing direction. If the printing positions (column positions of dot-matrix pattern) are the same in the first and second printing operations, the characters are printed with higher density. If the printing positions of the second printing are offset in a suitable direction from those of the first printing, the characters are bold-faced or thickened.

In the known dot-matrix printers, however, the overlap printing requires two printing movements of the print head, one for the normal printing by one group of dot-forming elements, and the other for the offset printing by the same group of dot-forming elements. Consequently, the known printers suffer from a comparatively long printing time for the overlap printing, and also suffers from relatively large error in the relative position between the normal first printing and the second offset printing of the characters, due to positioning error of the print head in the first and second movements for the overlap printing, resulting in insufficient print quality in the overlap printing.

SUMMARY OF THE INVENTION

It is therefore an object of the present invention to provide a dot-matrix printer which permits efficient printing operations without lowering the print quality, even when an overlap printing of characters is effected.

The above object may be achieved according to the principle of the present invention, which provides a dot-matrix printer for printing characters on a recording medium, in a matrix of dots wherein a plurality of rows of dots, each column consisting of a suitable number of dots and extending in a given direction, are arranged at a predetermined printing pitch in a printing direction which intersects the direction of extension of the columns of dots, the printer comprising: (a) a print head having a first and a second group of dot-forming elements which, when activated, form respective dots on the recording medium such that the dots formed by each of the first and second groups are arranged in the given direction, and such that the dots formed by the second group correspond to the dots formed by the first group, and are spaced in the printing direction, by a predetermined distance from the corresponding dots formed by the first group, if the first and second groups of dot-forming elements are activated similtaneously; (b) feeding means for moving the print head in the printing direction; (c) first printing control means for selectively activating the dot-forming elements of the first group of the print head, during movements of the print head, according to dot information corresponding to characters to be printed; and (d) second printing control means for selectively activating the dot-forming elements of the second group of the print head, also according to the dot information, such that the characters formed by the dots formed by the first group of dot-forming elements and the characters formed by the dots formed by the second group of dot-forming elements have a predetermined positional relation with each other.

In the dot-matrix printer of the present invention constructed as described above, same characters are printed on the recording medium, by the first and second groups of dot-forming elements of the print head, respectively, such that the character defined by the dots formed by the second group of dot-forming elements under the control of the second printing control means has a desired positional relation with the character formed by the first group of dot-forming elements. For example, the two characters may be completely superimposed on each other, or partially superimposed on each other or offset from each other by a desired direction.

According to the present invention, the overlap printing as described above can be effected without increasing the number of movements of the print head, as compared with the number in an ordinary printing operation. Consequently, the present printer does not suffer from an increased printing time for the overlap printing, as encountered in the known printer.

It is noted that a dot-matrix printer with a print head having only one group of dot-forming elements is capable of effecting an overlap printing during one movement of the print head in one printing direction, if a desired series of overlap characters (such as bold-faced characters) as printed according to the present invention are represented by the dot information per se, according to which the printing control means selectively activates the dot-forming elements during the movement of the print head. In this case, the dot information for the overlap characters is different from the dot information representative of ordinary or normal characters, and requires activation of the dot-forming elements such that a dot-to-dot distance, i.e., a distance between the adjacent dots is smaller than the nominal printing pitch of the printer used for printing ordinary characters. The dot-to-dot distance corresponds to the offset distance of the dots formed by the second group of dot-forming elements from the dots formed by the first group of dot-forming elements, according to the present invention.

If the dot-to-dot distance is close to zero (or smaller than and close to the nominal printing pitch), the same dot-forming elements must be activated two times successively during an extremely short time interval. The two successive activations of the same dot-forming elements requires a certain minimum time duration (minimum cycle time). If the dot-to-dot distance is smaller than a value corresponding to the required minimum cycle time of the dot-forming elements, the speed of movement of the print head during the overlap printing must be lowered than that during the normal printing at the predetermined printing pitch. Accordingly, the overlap printing requires a longer time than the normal printing. If the print head speed cannot be lowered below the normal printing speed, the dot-to-dot distance in the overlap printing cannot be sufficiently close to zero, due to the minimum cycle time requirement of the dot-forming elements.

In the present dot-matrix printer, each overlap character is formed by the character defined by the dots formed by the first group of dot-forming elements at the predetermined printing pitch, and by the dots which are formed also at the predetermined printing pitch by the second group of dot-forming elements. Therefore, the character printed by the second group of dot-forming elements may be offset by an extremely small distance from the character printed by the first group of dot-forming elements, without lowering the feeding speed of the print head, and therefore without increasing the required printing time. Thus, the instant printer is capable of effecting an overlap printing operation with a desired offset distance (which may be zero), while maintaining the normal feed rate of the print head.

The dot-forming elements of the print head may take various forms, such as: print wires or pins which are moved lengthwise to force at their ends a print ribbon against the recording medium, and thereby form corresponding dots on the medium; heat-generating elements for generating heat to fuse local portions of an ink material of a heat-sensitive print ribbon and transfer the fused ink material to the recording medium, thereby forming corresponding dots on the medium; and elements for producing jets of an ink or other printing fluid toward the recording medium, to form corresponding dots. It will be understood that the first and second groups of dot-forming elements may take different forms.

According to the principle of the invention, it is not essential that the dot-forming elements of the first group and the dot-forming elements of the second group be arranged in two parallel columns which extend in the above-indicated given direction (which intersects the printing direction). Instead, the two groups of dot-forming elements are required to assure that the dots formed by each of the first group of dot-forming elements are arranged in a row or column parallel to the above-indicated given direction, and that the dots formed by the second group correspond to the dots formed by the first group and are spaced in the printing direction by the predetermined distance from the corresponding dots formed by the first group, if the two groups are activated simultaneously.

Each of the first and second groups of dot-forming elements may be adapted such that the dots formed by each group are arranged in a plurality of parallel columns which extend in the above-indicated given direction.

The print head may have an additional group or groups of dot-forming elements, as necessary, other than the first and second groups.

The first group of dot-forming elements and the second group of dot-forming elements may have a same construction or arrangement, and are spaced from each other in the printing direction. In this case, the dots formed by the two groups have the same size and shape. However, the dot-forming elements of the two groups may have different constructions.

The term "correspond" in connection with the dots formed by the first and second groups of dot-forming elements means primarily that the centers of the dots formed by the dot-forming elements of the first group are aligned with the centers of the dots formed by the dot-forming elements of the second group, in the printing direction. However, the term also means that the dots formed by the two groups correspond to each other but are spaced from each other in the direction intersecting the printing direction. Where the dots formed by the two groups are aligned in the printing direction, the characters formed by the two groups may be completely superimposed on each other, or are partially superimposed on each other or offset from each other in the printing direction. Where the dots formed by the two groups correspond to each other in spaced-apart relation in the direction intersecting the printing direction, the two characters formed by the two groups are offset from each other in the direction intersecting the printing direction.

In view of the above, the printer may be adapted such that the the dot-forming elements of the first group correspond to the dot-forming elements of the second group in the printing direction, and such that the first and second printing control means control the first and second groups of dot-forming elements such that the dots formed by the first group of dot-forming elements are offset by a predetermined offset distance from the corresponding dots formed by the second group of dot-forming elements in the printing direction.

The first and second groups of dot-forming elements may be adapted such that the dots formed by the first group and the dots formed by the second group are spaced apart from each other in the printing direction, by a distance which is a multiple of the printing pitch, if the dots are formed by the two groups simultaneously. Alternatively, the two groups of dot-forming elements may be adapted such that the two groups of dots simultaneously formed by the respective first and second groups are spaced apart from each other by a sum of the above-indicated distance, and a desired offset distance between the two groups of dots. In either of these two cases, the second printing control means may be adapted to activate the second group of dot-forming elements, simultaneously with the first group of dot-forming elements. In these cases, the two groups of dots are simultaneously formed by the two groups of dot-forming elements, according to different sets of dot information. To attain the simultaneous activation of the first and second groups of dot-forming elements as indicated above, without lowering the feeding speed of the print head, the first and second groups of dot-forming elements may be spaced from each other in the printing direction by a distance Dc·n+2, where Dc, n and $\alpha$ respectively represent the printing pitch, a desired integer, and a positive value smaller than $\frac{1}{2}$.

In the above form of the invention, the dots formed by the first group of dot-forming elements and the dots formed by the second group of dot-forming elements are completely superimposed on each other, or partially superimposed on each other or offset from each other by a given distance in the printing direction. In this respect, it is preferable to provide suitable means for changing the offset distance as needed. To change the offset distance by a certain amount, the activation of the second group of dot-forming elements is delayed with respect to that of the first group, by a delay time which corresponds to the desired amount of change, i.e., by a time duration that is necessary for the print head to move a distance equal to the desired amount of change of the offset distance.

The printer may be adapted such that the dots formed by the first group of dot-foming elements, and the dots formed by the simultaneously activated second group may be spaced apart from each other in the direction perpendicular to the printing direction, as well as in the printing direction. In this case, the second printing control means may be adapted to activate the second group of dot-forming elements, simultaneously with the first group, or delay the activation of the second group with respect to that of the first group by a delay time corresponding to the desired offset distance of the two groups of dots. In this arrangement, the two groups of dots formed by the two groups of dot-forming elements are offset from each other in the direction perpendicular to the printing direction, or in both the printing direction and the direction perpendicular to the printing direction.

The printer may further comprise a dot map memory having a plurality of memory areas for storing the dot information representative of characters to be printed, in a dot-matrix pattern, such that the font data for each column of the dot-matrix pattern extending in the given direction is stored in a corresponding one of the memory areas. In this case, the first printing control means includes a first pointer for sequentially designating addresses of the memory areas of the dot map memory, and first commanding means for activating the first group of dot-forming elements according to the dot information designated by the first pointer, and the second printing control means includes a second pointer for sequentially designating the addresses of the dot map memory whose numbers are different from those of the addresses designated by the first pointer, by a value corresponding to a predetermined number of the memory areas, and second commanding means for activating the second group of dot-forming elements according to the dot information designated by the second pointer.

In the above form of the invention, the printer may further comprise reference signal generating means for generating reference position signals corresponding to incremental distances of movements of the print head by the feeding means, which distances are equal to the printing pitch, and a timing data memory for storing timing data representative of a delay time relating to the predetermined offset distance. In this instance, the first printing control means includes first driver means for activating the first group of dot-forming elements, in response to the reference position signals, and the second printing control means includes second driver means for activating the second group of dot-forming elements, when the delay time has elapsed after the reference position signals have been generated. The printer may comprise means for changing the delay time represented by the timing data stored in the timing data memory. Where the desired offset distance may be entered or designated, the delay time may be calculated based on the offset distance, and the timing data representive of the calculated delay time is stored in the timing data memory.

The first and second printing control means may be adapted to activate the first and second groups of dot-forming elements, while the print head is moved in a forward and a reverse direction by the feeding means. In this case, suitable reverse printing control means may be provided for controlling the first and second pointers such that a difference between the numbers of the addresses designated by the first and second pointers during the movements of the print head in the reverse direction is different by a value corresponding to one memory area of the dot map memory, from that during the movements of the print head in the forward direction. The reverse printing control means changes the delay time to a time duration used during the movements of the print head in the reverse direction, such that the time duration is equal to a difference obtained by subtracting the delay time from a time necessary to move the print head by a distance corresponding to the predetermined printing pitch, whereby the characters formed by the first group of dot-forming elements are offset from the characters formed by the second group of dot-forming elements in a same direction and by a same amount for both of the forward and reverse directions of movements of the print head.

Preferably, suitable means is provided for inhibiting the second printing control means from operating when it is not necessary to print characters that are defined by the dots formed by the second group of dot-forming elements.

According to another aspect of the present invention, there is provided a dot-matrix printer for printing characters on a recording medium, in a matrix of dots wherein a plurality of columns of dots each column consisting of a suitable number of dots and extending in a given direction are arranged at a predetermined printing pitch in a printing direction which intersects the direction of extension of the columns of dots, the printer comprising: (a) a print head having a first and a second group of dot-forming elements which, when activated, form respective dots on the recording medium such that the dots formed by each of the first and second groups are arranged in the given direction, and such that the dots formed by the second group correspond to the dots formed by the first group and are spaced in the printing direction, by a predetermined distance from the corresponding dots formed by the first group, if the first and second groups of dot-forming elements are activated similtaneously; (b) feeding means for moving the print head in the printing direction; (c) first font data memory means for storing sets of first print data each set being representative of every two columns of a dot-matrix pattern of characters; (d) first driving means for sequentially receiving the sets of first print data from the first font data memory means, in response to respective incremental movements of the print head by an incremental distance which is two times as large as the predetermined printing pitch, and selectively activating the dot-forming elements of the first group of the print head, according to the received sets of first print data; (e) second font data memory means for storing sets of second print data each set being representative of every two columns of the dot-matrix pattern which are different from the every two columns represented by the first print data; and (f) second driving means for sequentially receiving the sets of second print data from the second font data memory means, in response to the incremental movements of the print head by the incremental distance, and for selectively activating the dot-forming elements of the second group of the print head, according to the received sets of second print data, such that dots formed by the second group of dot-forming elements are offset by a distance corresponding to the printing pitch from dots formed by the first group of dot-forming elements.

In the dot-matrix printer constructed as described above, ordinary characters may be formed by the dots printed by the first group of dot-forming elements according to the first print data supplied from the first font data memory means, and the dots which are printed by the second group of dot-forming elements according to the second print data supplied from the second font data memory means, such that the dots formed by the second group are offset from the dots formed by the first group, by a distance corresponding to the printing pitch. Therefore, the ordinary characters may be printed at a higher speed than in a dot-matrix printer with one group of dot-forming elements.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which.

PREFERRED EMBODIMENTS OF THE INVENTION

Referring to the accompanying drawings, the presently preferred embodiments of the invention as applied to a dot-matrix serial impact printer with a wire-dot print head will be described.

The dot-matrix printer according to the invention is basically identical in construction with a known dot-matrix printer with a print head having print wires. Namely, a carriage is disposed movably right and left in the printing direction, i.e., in the lateral direction of the printer, while a platen for supporting a recording medium is disposed adjacent to the carriage. The carriage carries a print head 10 shown in front elevation in a right upper portion of FIG. 1, such that the print head 10 is movable together with the carriage, in facing relation with the recording medium via a suitable print ribbon. The carriage is reciprocated in the lateral direction, by a carriage motor 12 indicated at a right middle portion of FIG. 1.

Figure 1:
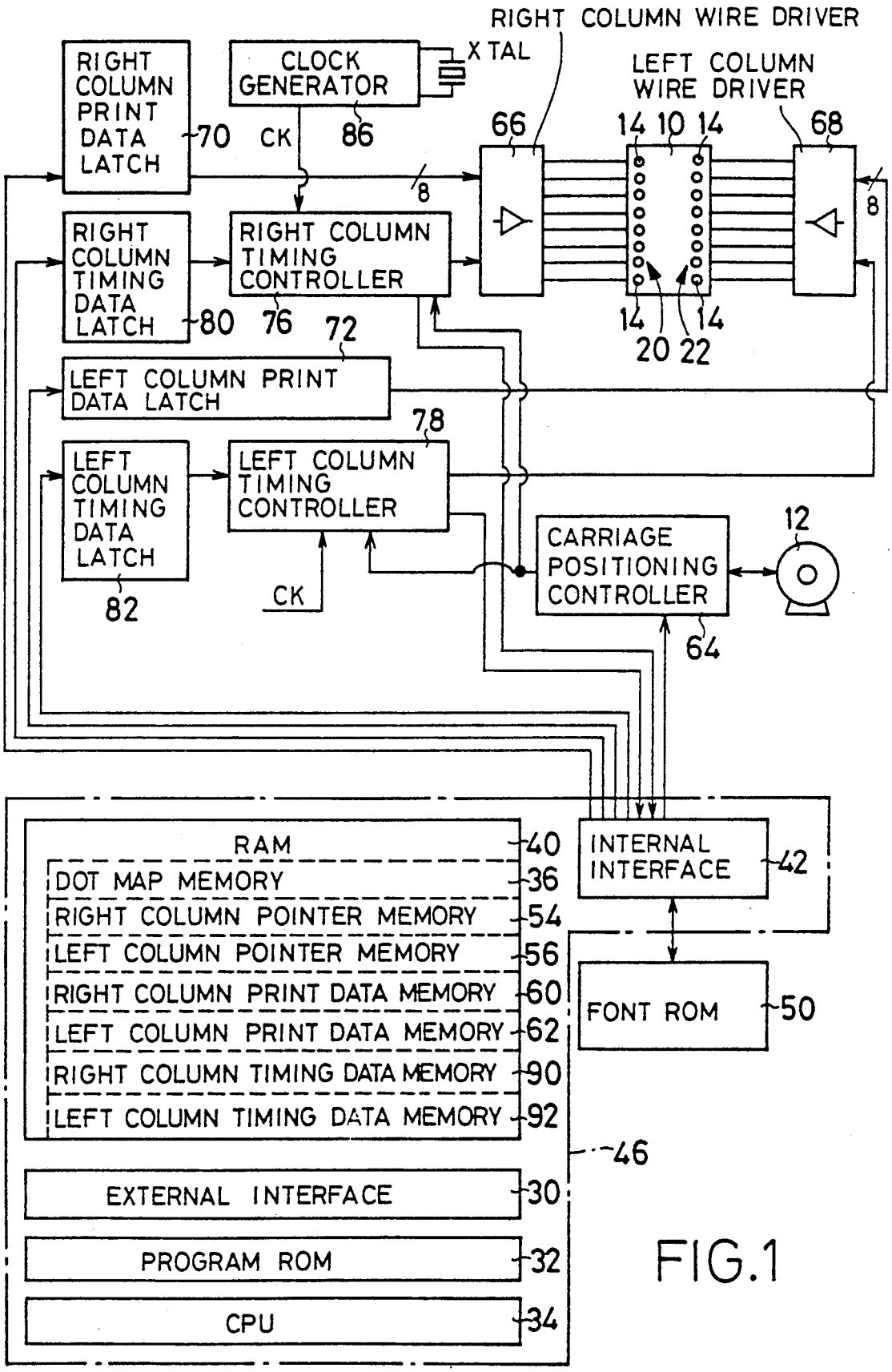
FIG. 1 is a schematic view of one embodiment of a dot-matrix printer of the invention, illustrating a wire-dot print head of the printer in front elevation (as seen in a direction from a recording paper toward the print head), and an electric control system of a main control device of the printer.

The print head 10 has two arrays of printing elements, in the form of two parallel vertical columns 20, 22 of print wires 14, each column consisting of eight print wires each for printing a dot. The first or right column 20 and the second or left column 22 are disposed at relatively right and left portions of the face of the print head 10, respectively, as viewed in the direction from the print head 10 toward the recording medium. However, the right and left rows 20, 22 as shown in FIG. 1 are disposed at the reversed positions, since FIG. 1 is an elevational view taken in the direction from the recording medium toward the face of the print head 10.

Figure 2:
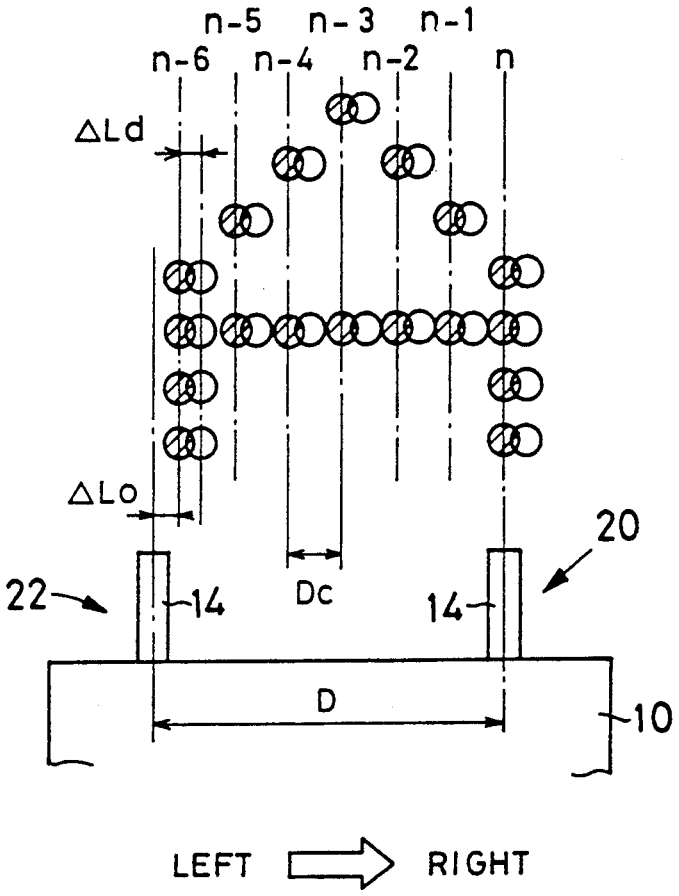
FIG. 2 is an illustration of an example of overlap printing by the wire-dot print head to print a character according to the principle of the invention.

The eight print wires 14 of the right column 20 correspond to or are aligned with the eight print wires 14 of the left column 22, in the printing or lateral direction of the printer, and the corresponding print wires 14 of the right and left columns 20, 22 are spaced apart from each other in the printing direction by a distance D which is equal to a sum of a normal printing pitch Dc (normal dot-to-dot distance) multiplied by six (6), and an extra distance $\Delta Lo$, as indicated in FIG. 2 (plan view of the print head 10). That is, $D=(6\times Dc)+\Delta Lo$.

Figure 3:
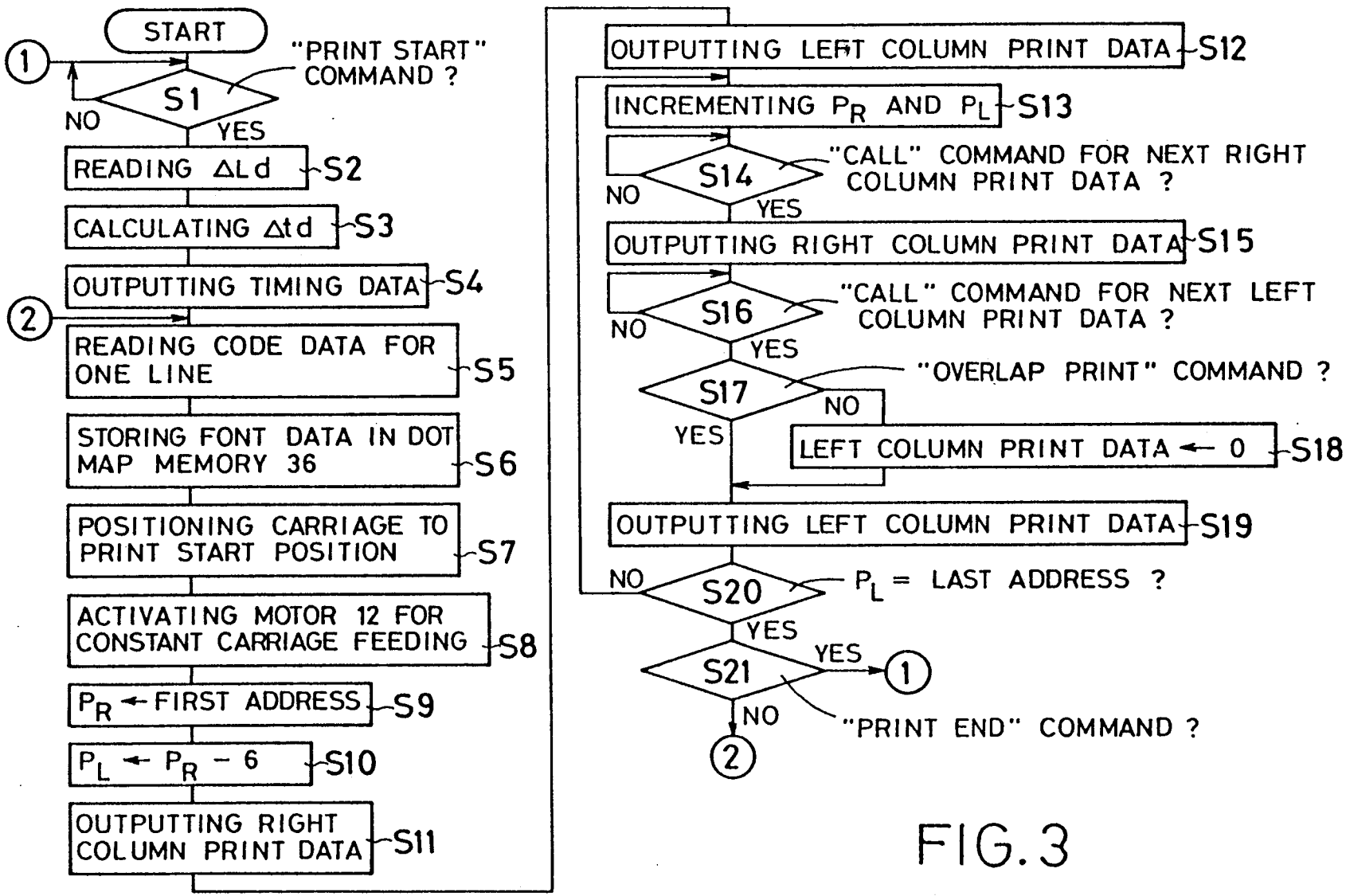
FIG. 3 is a flow chart showing a control program stored in the main control device of the printer.

Referring back to FIG. 1, there will be described a main control device of the present printer. The main control device includes a central controller indicated at 46 in FIG. 1. The central controller 46 is constituted by a computer which includes an external interface 30 indicated at a left lower portion of FIG. 1, a PROGRAM ROM (read-only memory) 32 which stores a control program illustrated in the flow chart of FIG. 3, a CPU (central processing unit ) 34, a RAM (random-access memory) 40 including a DOT MAP memory 36 and various other memories, an internal interface 42, and a data bus (not shown).

The central controller 46 receives at its external interface 30, code data supplied from suitable input means and feeds the received code data through the internal interface 42 to a FONT ROM (read-only memory) 50, so that font data necessary to print characters corresponding to the code data on the recording medium is received from the FONT ROM 50 and stored in the DOT MAP memory 36. The present dot-matrix serial impact printer is adapted to print lines of characters, one line after another, and the DOT MAP memory 36 is adapted to store a batch of font data corresponding to one line of characters. More specifically, the DOT MAP memory 36 stores a series of dot information representative of the presence or absence of dots to be printed on the recording medium by the corresponding print wires 14 of the right and left columns 20, 22 while the print head 10 is moved in the determined printing direction, such that sets of dot information at the successive column positions are stored at respective successive addresses of the memory 36. While the printing may be effected in either the right direction or the left direction, the order in which the sets of dot information for a line are stored in the memory 36 differs depending upon the selected printing direction of that line.

The RAM 40 further includes a RIGHT COLUMN pointer memory 54 and a LEFT COLUMN pointer memory 56, which store address number data for sequentially designating the addresses of the DOT MAP memory 36 at which are stored the sets of dot information to be used for the next printing columns by the right and left columns 20, 22 of print wires 14, respectively. The RAM 40 further includes a RIGHT COLUMN print data memory 60 and a LEFT COLUMN print data memory 62, which store, as right-column print data and left-column print data, the sets of dot information which are stored at the addresses of the DOT MAP memory 36 that are currently designated by the address number data stored in the pointer memories 54, 56.

The main control device further includes carriage positioning controller 64 for controlling the carriage motor 12, according to signals received from the central controller 46. The carriage positioning controller 64 is capable of detecting, based on the operating phase of the motor 12, the times at which the carriage has been moved each incremental feed distance equal to the normal printing pitch Dc. Thus, the controller 64 also functions as means for generating reference position signals indicative of each printing position or column position along the printing direction.

The main control device further includes a RIGHT COLUMN wire driver 66 and a LEFT COLUMN wire driver 68, which are respectively connected to the right and left print wire columns 20, 22. These wire drivers 66, 68 are connected to the central controller 46, through a RIGHT COLUMN print data latch 70 and a LEFT COLUMN print data latch 72, respectively. The RIGHT COLUMN wire driver 66 is connected to the central controller 46, also through a RIGHT COLUMN timing controller 76 and a RIGHT COLUMN timing data latch 80. Similarly, the LEFT COLUMN wire driver 68 is connected, also through a LEFT COLUMN timing controller 78 and a LEFT COLUMN timing data latch 82. The wire drivers 66, 68 are normally placed in a deenergized or off state. In an energized or ON state, the wire drivers 66, 68 activate the appropriate print wires 14 of the corresponding right and left rows 20, 22, to print dots on the recording medium, according to the print data stored in the print data latches 70, 72. The functions of the timing controllers 76, 78 will be described later. The timing controllers 76, 78 are adapted to receive clock pulses CK produced by a clock generator 86.

The principle of an overlap printing operation in the present embodiment will be explained, by reference to an example illustrated in FIG. 2 wherein English letter "A" is printed in a bold-faced fashion. In this figure, hatched circles indicate the dots which are printed by the print wires 14 of the right column 20, at the successive column positions of the dot matrix, at the printing pitch Dc in the printing direction, i.e., in the right direction in this specific example.

In the illustrated example, the positions of the dots to be printed by the print wires 14 of the left column 22 are offset to the right with respect to those of the dots of the letter "A" printed by the print wires 14 of the right column 20, by an offset distance ΔLd which is smaller than a half of the normal printing pitch Dc but is larger than "0" (zero). Namely, the letter "A" to be printed by the left column 22 is offset in the right direction by the above distance with respect to the letter "A" to be printed by the right column 20. Assuming that the print wires 14 of the right and left columns 20, 22 are simultaneously activated, the positions of the dots printed by the left print wire column 22 are offset to the left by a distance (6Dc +ΔLo) from those of the dots printed by the right print wire row 20. If the printing by the left print wire row 22 is effected according to the dot information or print data designated by the address numbers of the DOT MAP memory 36 which are smaller by "6" than those for the right print wire column 20, the positions of the dots printed by the left print wire column 20 are offset to the left (rearward in the printing direction) by a distance ΔLo from those of the right print wire column 20. Therefore, if the supply of the print data for the left print wire row 22 to the LEFT COLUMN print data latch 72 is delayed with respect to that for the right print wire column 20 to the RIGHT COLUMN print data latch 70, by a time corresponding to the six printing columns, the dots printed by the left print wire column 22 can be offset by a distance ΔLd to the right with respect to the dots printed by the right print wire column 20, by delaying the time of activation of the left print wire row 22, by a time duration Δtd which is necessary for the print head 10 to be fed by a distance (ΔLo+ΔLd) at a feed rate V. As a result, the dots forming the overlying letter "A" are printed by the left print wire row 22, as indicated by non-hatched circles in FIG. 2. The data representative of this delay time Δtd is the timing data stored in the LEFT COLUMN timing data latch 82.

In the above example in which the printing is effected in the right direction, the printing actions of the print wires 14 of the right column 20 occur at the predetermined nominal times at the nominal column positions, and the printing actions of the print wires 14 of the column row 22 are delayed by the delay time Δtd with respect to those of the right print wire column 20. If the printing is effected in the left direction, the printing actions of the left print wire column 22 occur at the nominal times at the nominal column positions, and the printing actions of the right print wire column 20 are delayed by the delay time Δtd of the left print wire column 22. The RAM 40 includes a RIGHT COLUMN timing data memory 90 and a LEFT COLUMN timing data memory 92, which store the sets of timing data indicative of the delay time Δtd for the right and left columns 20, 22, respectively.

The operation of the present dot-matrix printer will be described below. The following description refers only to the rightward printing operation, and no description of the leftward printing operation will be provided, because of its similar nature in substance to the rightward printing operation.

Upon application of power to the printer, the control program stored in the PROGRAM ROM 32 (as illustrated in the flow chart of FIG. 3) is executed. Initially, the control flow goes to step S1 to determine whether the central controller 46 has received a "PRINT START" command from the input means. If the command is present, step S1 is followed by step S2 wherein the CPU 34 receives data indicative of the offset distance ΔLd from the input means, and step S3 wherein the delay time Δtd is calculated from the received offset distance ΔLd. The control flow then goes to step S4 in which the timing data indicative of no delay ("0") for the right print wire column 20 is sent to the RIGHT COLUMN timing data latch 80, while the timing data indicative of the delay time Δtd for the left print wire column 22 is sent to the LEFT COLUMN timing data latch 82.

Then, step S5 is executed to receive from the input means code data corresponding to one line of characters. In the next step S6, the DOT MAP memory 36 is cleared to erase the font data already stored, and sets of the font data corresponding to the received code data for the line to be printed are sequentially stored in the DOT MAP memory 36. Step S6 is followed by step S7 wherein the carriage is positioned at the print start position, and step S8 wherein a command for activating the carriage motor 12 to feed the carriage at a constant rate is produced. The carriage motor 12 is activated a suitable time after the generation of the above activating command. Thus, the carriage is moved in the right direction at the predetermined rate.

The control flow then goes to step S9 in which the number represented by the address number data stored in the RIGHT COLUMN pointer memory 54, that is, a right column pointer value $P_R$ is set to the number of the first address of the DOT MAP memory 36. In the next step S10, the number represented by the address number data stored in the LEFT COLUMN pointer memory 56, that is, a left column pointer value $P_L$ is set equal to $(P_R-6)$. With the pointer value $P_L$ of the pointer memory 56 being smaller by "6" than the pointer value $P_R$ of the pointer memory 54, the print data at the same address of the DOT MAP memory 36 (for the same column position) is supplied as the left column print data to the LEFT COLUMN print data latch 72, with a time delay corresponding to six columns of the dot-matrix pattern, with respect to the right column print data which is supplied to the RIGHT COLUMN print data latch 70. In this respect, it is noted that where the left column print data designated by the LEFT COLUMN pointer memory 56 does not exist in the DOT MAP memory 36 (where the address of the memory 36 designated by the poiner memory 56 does not exist, and the address number data of the pointer memory 56 cannot be effectively executed), the LEFT COLUMN print data latch 72 stores print data which does not cause the activation of any print wires 14 of the left column 22 for producing dots on the recording medium. This situation occurs, for example, where the pointer value $P_R$ of the RIGHT ROW pointer memory 54 designates the first address of the DOT MAP memory 36. Similarly, the RIGHT COLUMN print data latch 70 stores print data which does not cause the activation of any print wires 14 of the right column 20, where the pointer value $P_L$ of the LEFT COLUMN pointer memory 56 designates the last address of the DOT MAP memory 36, for example.

In step S11 following the above steps S9 and S10, the right column print data currently stored in the RIGHT COLUMN print data memory 60 is stored into the RIGHT COLUMN print data latch 70. In the following step S12, the left column print data currently stored in the LEFT COLUMN print data memory 62 is stored into the LEFT COLUMN print data latch 72.

The time at which the carriage motor 12 is activated in response to the activating command in step S8 is delayed a predetermined time so that the activation takes place after the above indicated steps S11 and S12 have been executed. Accordingly, the reference position signals are supplied from the carriage positioning controller 64 to the timing controllers 76, 78, also after the execution of the steps S11 and S12. When the first reference position signal is received by the timing controllers 76, 78, the RIGHT COLUMN timing controller 76 immediately energizes the RIGHT COLUMN wire driver 66 to activate the appropriate print wires 14 of the right column 20, since the timing data currently stored in the RIGHT COLUMN timing data latch 80 represents no delay time (i.e., Δtd=0). To the contrary, the LEFT COLUMN timing controller 78 energizes the LEFT COLUMN wire driver 68 to activate the appropriate print wires 14 of the left column 22, at a later time which is subsequent to the moment of reception of the reference position signal, by the delay time Δtd represented by the timing data stored in the LEFT COLUMN timing data latch 82. In the first printing action corresponding to the first column, however, the LEFT COLUMN print data latch 72 stores left column print data which will cause no printing of dots, since there exists no address designated by the pointer value $P_L$, in the DOT MAP memory 36. Therefore, the print wires 14 of the left row 22 are not activated when the wire driver 68 is energized the predetermined delay time after the energization of the wire driver 66.

After the energization of the wire drivers 66, 68, the timing controllers 76, 78 send to the internal interface 42 of the central controller 46, CALL commands which call for the next right column print data and the next left column print data. The manner in which these CALL commands are generated will be described later.

The control flow then goes to step S13 in which the pointer values $P_R$ and $P_L$ of the pointer memories 54, 56 are incremented. Step S13 is followed by step S14 to determine whether the CALL comand for the next right column print data has been received by the internal interface 42. If the CALL command for the next right column print data is present, the control flow goes to step S15 in which the print data at the address of the DOT MAP memory 36 which is designated by the updated pointer value $P_R$ and currently stored in the print data memory 60 is supplied as the next right row print data to the RIGHT COLUMN print data latch 70. As a result, the printing of dots by the right print wire row 20 is effected to the print data in the latch 70, immediately after the next reference position signal is received by the RIGHT COLUMN timing controller 76.

Step S16 is then implemented to determine whether the CALL command for the next left column print data has been received from the LEFT COLUMN timing controller 78, or not. If this CALL command is present, step S17 is executed to determine whether an OVERLAP PRINT command has been received from the input means, or not. If the OVERLAP PRINT command is not present, step S17 is followed by step S18 in which the LEFT COLUMN print data latch 72 stores the print data which causes no printing of dots by the left print wire dots 22. If the OVERLAP PRINT command is present, the control flow goes to step S19, skipping step S18. In either case, the appropriate left column print data is stored into the data latch 72, in step S19. As a result, the printing operation by the left print wire row 22 is effected according to the print data in the data latch 72, after the predetermined delay time Δtd after the moment at which the second reference position signal from the carriage positioning controller 64 is received by the LEFT COLUMN timing controller 78.

Figure 4:
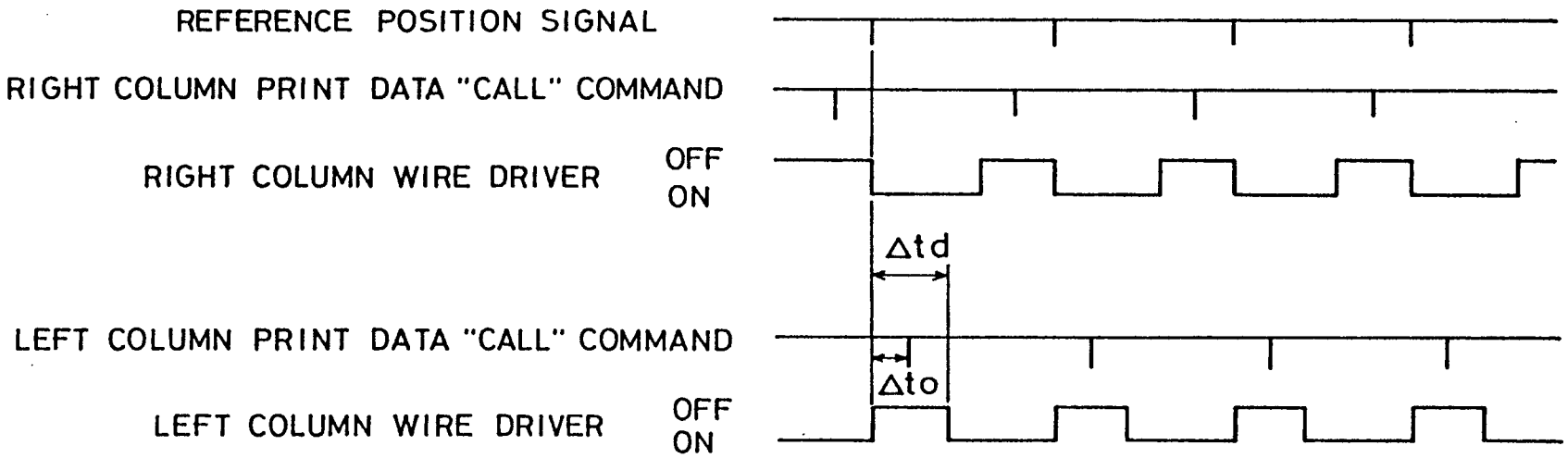
FIG. 4 is a timing chart for explaining operations of timing controllers for right and left print wire columns of the print head.

Referring to the timing chart of FIG. 4, there will be described in detail the manner in which the RIGHT COLUMN and LEFT COLUMN timing controllers 76, 78 are operated.

The RIGHT COLUMN timing controller 76 will be first described. Upon application of the reference position signal to the timing controller 76, with the delay time Δtd for the right print wire column 20 being "0", the timing controller 76 brings the RIGHT COLUMN wire driver 66 from its deenergized or OFF state to the energized or ON state as soon as the reference position signal has been received. After the wire driver 66 is kept in the ON state for a predetermined time duration, the CALL command for the next right column print data is fed from the timing controller 76 to the central controller 46. The time of generation of this CALL command is determined such that the next right column print data has been supplied from the central controller 46 to the RIGHT COLUMN print data latch 70 in response to the relevant CALL command, before the next reference position signal has been received by the timing controller 76.

Then, the LEFT COLUMN timing controller 78 will be described. Upon application of the reference position signal to the timing controller 78, the LEFT COLUMN wire driver 68 is brought from its OFF state to its ON state, the predetermined delay time Δtd after the moment at which the reference position signal has been received. After the wire driver 68 is kept in its ON state, the LEFT COLUMN timing controller 78 supplies the central controller 46 with the CALL command for the next left column print data, in the same manner as described above with respect to the timing controller 76. The time at which this CALL command is generated by the timing controller 78 is determined such that the next left column print data has been supplied from the central controller 46 to the LEFT COLUMN print data latch 72 in response to the relevant CALL command, before the moment at which the dots to be printed by the left print wire column 22 are aligned with the normal column position of the right print wire column 20 at the nominal printing pitch Dc, i.e., before the moment at which a time Δto necessary for the print head 10 to move the above-indicated distance ΔLo has elapsed after the time of activation of the right print wire column 20.

After the right row print data and the left row print data are supplied to the respective wire drivers 66, 68 to activate the appropriate print wires 14, step S20 is implemented to detemine whether the pointer value $P_L$ of the LEFT COLUMN pointer memory 62 designates the last address of the DOT MAP memory 40, or not, namely, to determine whether the print data for the relevant line of characters has been executed to complete the printing of the entire line. If not, the control flow goes back to step S13. If the pointer value $P_L$ is currently designating the last address, step S21 is implemented to determine whether a PRINT END command has been received from the input means. If the PRINT END command is not present, the control flow goes back to step S5 to print the next line of characters. If the PRINT END command is present, the control flow returns to step S1 to await the next PRINT START command for another printing job.

It is noted that the right column print data and the left column print data for the first column of the print line are applied to the print data latches 70, 72, without the central controller 46 receiving the the CALL commands from the timing controllers 76, 78. This is because the CALL commands are generated by the timing controllers 76, 78, only after the wire drivers 66, 68 have been energized to activate the print wires 14. That is, the CALL commands calling for the print data for printing the first column are not generated by the timing controllers 76, 78.

According to the illustrated embodiment described above, an overlap printing of a character (letter "A") by the two print wire columns 20, 22 is effected with a normal printing at the nominal printing positions, and with an offset printing with an offset distance less than the half of the nominal printing pitch Dc from the nominal printing columns in the printing direction, with a single movement of the print head 10 in the printing direction. Accordingly, the time required for the overlap printing operation is substantially the same as that for an ordinary printing.

Further, the present dot-matrix printer permits the overlap printing to be performed with a desired offset distance designated through the input means, while moving the print head 10 at a relatively high feed rate as used in an ordinary printing. Thus, the present printer has improved high degrees of freedom and versatility in terms of the overlap printing conditions.

It will be understood from the foregoing description that the right print wire row 20 serves as a first array of print wires 14, while the left print wire row 22 serves as a second array of print wires 14, where the printing is effected in the right direction. In this case, first printing control means for controlling the first print wire array 20 is constituted by the wire driver 66, print data latch 70, timing controller 76, timing data latch 80, and the portions of the central controller 46 which are associated with the right print wire row 20. Similarly, second printing control means for controlling the second print wire array 22 is constituted by the wire driver 68, print data latch 72, timing controller 78, timing data latch 82, and the portions of the central controller 46 associated with the second print wire array 22. Where the printing is effected in the left direction, the first and second print wire arrays, and the first and second printing control means are reversed, with respect to the "right" and "left" adjectives of the elements indicated above.

It will also be understood that the direction of offsetting from the nominal printing positions is in the right direction where the overlap printing is effected in the right direction, while the offsetting direction is in the left direction where the overlap printing is in the left direction. Therefore, if the printer is adapted to effect the overlap printing operation such that the two adjacent lines are printed in the opposite directions, the offset printing operations of the two adjacent lines are effected in the opposite directions. In this case, the positions of the overlap characters of one of the two lines may appear to be somewhat different from those of the other line.

Figure 5:
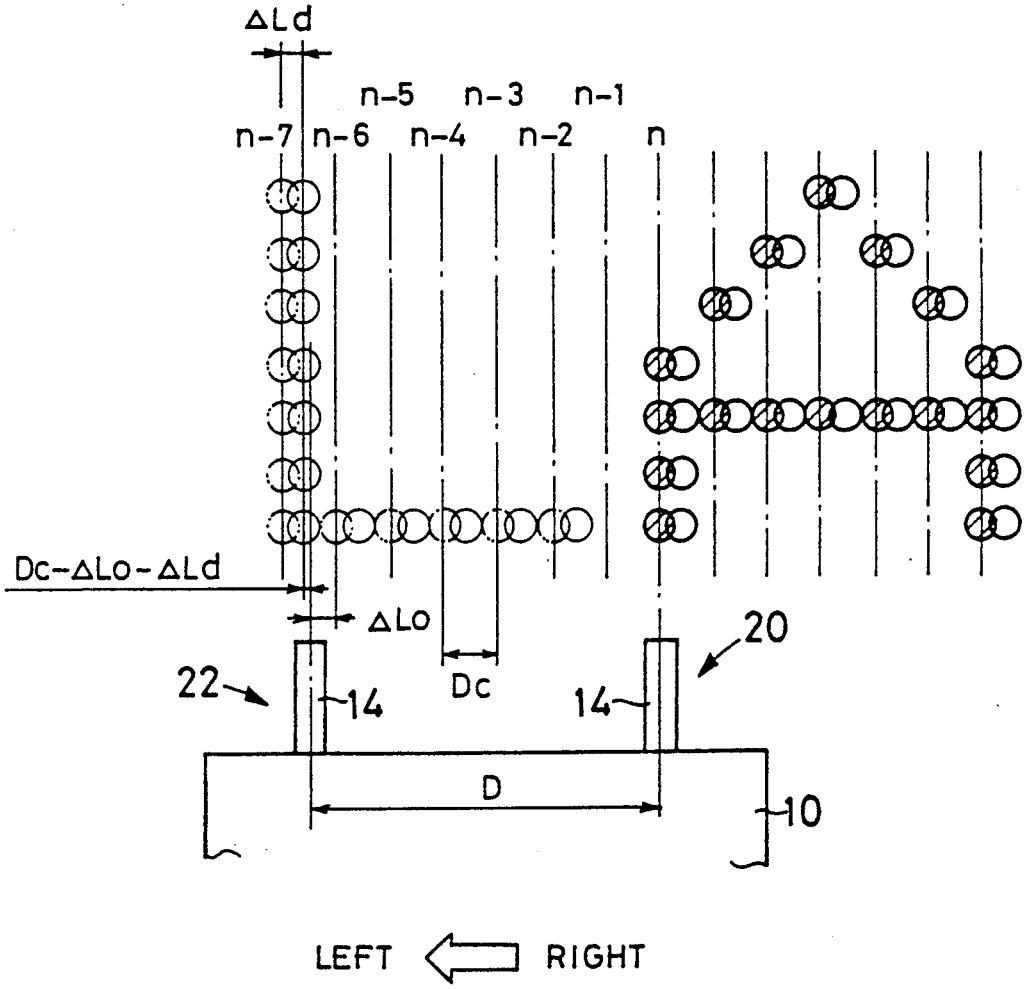
FIG. 5 is an illustration of an another example of overlap printing by the print head according to a control program different from that used in the example of FIG. 2.

The above phenomenon may be avoided by adapting the printer such that the offsetting direction remains in the same one direction while the overlap printing operations (normal and offset printing operations by the two print wire columns 20, 22) are effected in the opposite directions for the adjacent two lines of characters. An example of the thus modified printer is illustrated in FIG. 5.

In this modified embodiment, the overlap printing operations in the right direction are carried out in the same manner as described above. However, the overlap printing operations in the left direction are modified so that the direction of offset of the characters in the offset printing remains in the right direction even in the leftward overlap printing operation. That is, while the print head 10 is moved in the left direction, the print wires 14 of the right column 20 are controlled so as to print dots at the nominal column positions at the nominal printing pitch, while the print wires 14 of the left column 22 are controlled to effect an offset printing such that the dots printed by the left print wire column 22 are offset by the desired offset distance ΔLd in the right direction from the nominal column positions. More specifically, the left print wire column 22 is operated according to the print data or dot information which is stored at the address number of the DOT MAP member 36 which is smaller than "7" than that of the dot information for the right print wire column 20. Further, the time at which the print wires 14 of the left column 22 are activated is delayed with respect to the time of activation of the right print wire column 20, by a delay time which corresponds to a distance (Dc−ΔLo−ΔLd). According to this arrangement, the offset character (indicated by non-hatched solid line circles in FIG. 5) is spaced from the nominal or normally printed character (indicated by hatched solid line circles and two-dot chain line circles, in the figure), in the right direction by the distance ΔLd.

Figure 6:
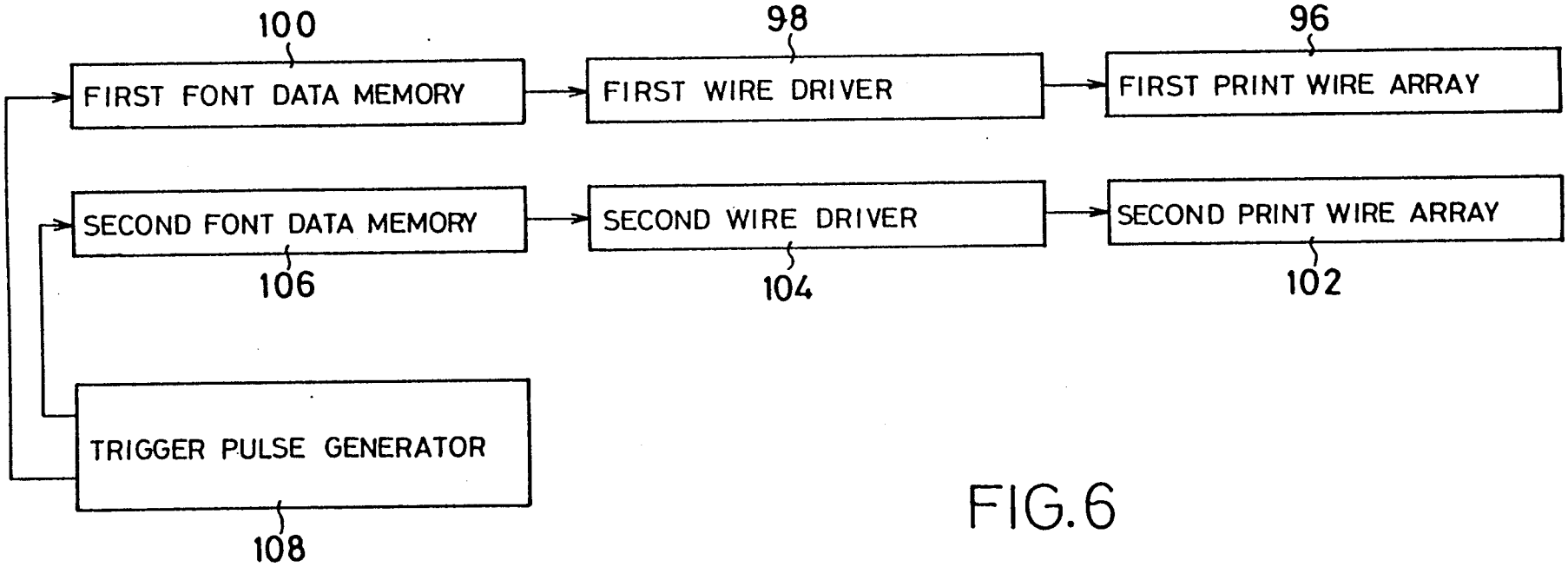
FIG. 6 is a block diagram showing another embodiment of the present invention.

While the second printing control means is provided for controlling the offset printing, in the illustrated embodiments, the second printing control means may be used for other purposes. For instance, the second printing control means may be used for improving the speed of printing of ordinary characters. For example, the printer may be modified as illustrated in FIG. 6, wherein reference numeral 96 denotes a first print wire array which is disposed on the leading side of the print head 10 in the printing direction, and reference numeral 102 denotes a second print wire array which is disposed on the trailing side of the print head 10. In the rightward printing, the first and second print wire arrays 96, 102 correspond to the right and left print wire columns 20, 22 of the preceding embodiments, respectively. The first print wire array 96 is driven by a first wire driver 98, which is provided with dot information or print data supplied from a first font data memory 100. The second print wire array 102 is driven by a second wire driver 104, which is provided with print data supplied from a second font data memory 102. A batch of the print data stored in the first font data memory 100, and a batch of the print data stored in the second font data memory 106 are prepared so that the dots printed according to these two batches of print data combine to form a line or lines of ordinary or normal characters. The first and second font data memories 100, 106 supply the print data to the first and second wire drivers 98, 104, in response to trigger pulses generated by a trigger pulse generator 108. The trigger pulses generated by the trigger generator 108 are supplied alternately to the first and second font data memories, such that the first and second drivers 98, 104 are alternately energized at time intervals corresponding to a printing pitch which is two times as large as the normal printing pitch Dc. In this arrangement, the dots are printed by the second print wire array 102, at the column positions which are intermediate between the adjacent column positions of the dots printed by the first print wire array 96. Thus, a series of ordinary characters may be formed by the dots printed by the first print wire array 96 according to the print data supplied from the first font data memory 100, and the dots printed by the second print wire array 102 according to the print data supplied from the second font data memory 106. The present arrangement permits the printing of ordinary characters at a higher speed than in an ordinary dot-matrix printer.

It is to be understood that the present invention may be embodied with various other changes, modifications and improvements, which may occur to those skilled in the art, without departing from the spirit and scope of the invention defined in the following claims.

What is claimed is:

1. A dot-matrix printer for printing characters on a recording medium, in a matrix of dots wherein a plurality of columns of printed dots each column consisting of a suitable number of dots and extending in a given direction are arranged at a predetermined printing pitch in a printing direction which intersects the direction of extension of the columns of printed dots, comprising:

a print head having a first and a second group of dot-forming elements which, when activated, form respective dots on the recording medium such that the dots formed by each of said first and second groups are arranged in said given direction, and such that the dots formed by said second group correspond to the dots formed by said first group, and are spaced in said printing direction, by a predetermined distance from the corresponding dots formed by said first group, if said first and second groups of dot-forming elements are activated simultaneously; feeding means for moving said permit head in said printing direction;

memory means for storing dot data representative of dots of each character to be printed in a dot-matrix pattern, said dot data consisting of a plurality of sets of dot information which correspond to respective columns of said dot-matrix pattern;

first printing control means for executing all of said plurality of sets of dot information and thereby selectively activating the dot-forming elements of said first group of said print head to form said each character, during a movement of said print head; and second printing control means for executing all of said plurality of sets of dot information and thereby selectively activating the dot-forming elements of said second group of said print head to form said each character during the same movement, such that the characters formed by the dots formed by said first group of dot-forming elements according to said plurality of sets of dot information and the characters formed by the dots formed by said second group of dot-forming elements according to said plurality of sets of dot information have a predetermined positional relation with each other.

2. A dot-matrix printer according to claim 1, wherein said first group of dot-forming elements and said second group of dot-forming elements have a same construction, and are spaced from each other in said printing direction.

3. A dot-matrix printer according to claim 1, wherein the dot-forming elements of said first group correspond to the dot-forming elements of said second group in said printing direction, and said first and second printing control means control said first and second groups of dot-forming elements such that the dots formed by said first group of dot-forming elements are offset by a predetermined offset distance from the corresponding dots formed by said second group of dot-forming elements in said printing direction.

4. A dot-matrix printer according to claim 3, wherein said first and second groups of dot-forming elements are spaced from each other in said printing direction by a distance $$[Dc(n+\alpha)]Dc\cdot n+\alpha,$$

where

Dc = said printing pitch, n = an integer, and $\alpha$ = a positive value smaller than $\frac{1}{2}$.

5. A dot-matrix printer according to claim 3, further comprises means for changing said predetermined offset distance.

6. A dot-matrix printer according to claim 3, wherein said memory means comprises a dot map memory having a plurality of memory areas for storing said plurality of sets of dot information representative of each character to be printed, in a dot-matrix pattern, such that a set of dot information for each column of the dot-matrix pattern extending in said given direction is stored in a corresponding one of said memory areas, and wherein said first printing control means includes a first pointer for sequentially designating addresses of said memory areas of said dot map memory, and first commanding means for activating said first group of dot-forming elements according to the set of dot information designated by said first poiner, and wherein said second printing control means includes a second pointer for sequentially designating the addresses of said memory areas of said dot map memory whose numbers are different from those of the addresses designated by said first pointer, by a value corresponding to a predetermined number of said memory areas, and second commanding means for activating said second group of dot-forming elements according to the set of dot information designated by said second pointer.

7. A dot-matrix printer according to claim 6, further comprising reference signal generating means for generating reference position signals corresponding to incremental distances of movements of said print head by said feeding means, which distances are equal to said printing pitch, and a timing data memory for storing timing data representative of a delay time relating to said predetermined offset distance, and wherein said first printing control means includes first driver means for activating said first group of dot-forming elements, in response to said reference position signals, and said second printing control means includes second driver means for activating said second group of dot-forming elements, when said delay time has elapsed after said reference position signals have been generated.

8. A dot-matrix printer according to claim 7, further comprising means for changing said delay time represented by said timing data stored in said timing data memory.

9. A dot-matrix printer according to claim 8, wherein said means for changing said delay time includes means for entering said offset distance, and means for calculating said delay time based on said offset distance and storing in said timing delay memory the timing data representative of the calculated delay time.

10. A dot-matrix printer according to claim 7, wherein said first and second printing control means activate said first and second groups of dot-forming elements, while said print head is moved in a forward and a reverse direction by said feeding means, said printer further comprising reverse printing control means for controlling said first and second pointers such that a difference between the numbers of the addresses designated by said first and second pointers during the movement of said print head in said reverse direction is different by a value corresponding to one memory area of said dot map memory, from that during the movement of the print head in said forward direction, said reverse printing control means changing said delay time to a time duration used during the movement of said print head in said reverse direction, such that said time duration is equal to a difference obtained by subtracting said delay time from a time necessary to move said print head a distance corresponding to said predetermined printing pitch, whereby the characters formed by said second group of dot-forming elements are offset from the characters formed by said first group of dot-forming elements in a same direction and by a same amount for both of said forward and reverse directions of movements of said print head.

11. A dot-matrix printer according to claim 3, further comprising means for inhibiting said second printing control means from operating when it is not necessary to print characters that are defined by the dots formed by said second group of dot-forming elements.

* * * * *